US008578556B1

(12) United States Patent
Yu

(10) Patent No.: US 8,578,556 B1
(45) Date of Patent: Nov. 12, 2013

(54) AUTO-RETURN APPARATUS FOR GLASS DOOR

(75) Inventor: King-Sung Yu, ChangHua County (TW)

(73) Assignee: Leado Door Controls Ltd., YuanLin Township, ChangHua County (TW)

( * ) Notice: Subject to any disclaimer, the term of this patent is extended or adjusted under 35 U.S.C. 154(b) by 0 days.

(21) Appl. No.: 13/598,391

(22) Filed: Aug. 29, 2012

(30) Foreign Application Priority Data

Jul. 6, 2012 (TW) ..... 101124484 A

(51) Int. Cl.
*E05F 3/22* (2006.01)
*E05D 5/02* (2006.01)

(52) U.S. Cl.
USPC ..... 16/53; 16/54; 16/50; 16/252; 16/240; 16/245

(58) Field of Classification Search
USPC ..... 16/286, 252, 236, 382, 332, 330, 245, 16/54, 50, 237, 240, 49; 4/607, 614, 557, 4/556; 49/137, 138, 339, 323, 344
See application file for complete search history.

(56) References Cited

U.S. PATENT DOCUMENTS

| | | | | |
|---|---|---|---|---|
| 3,646,635 | A * | 3/1972 | Stermac | 16/239 |
| 3,828,394 | A * | 8/1974 | Horgan, Jr. | 16/241 |
| 4,977,642 | A * | 12/1990 | Marinoni | 16/257 |
| 5,483,770 | A * | 1/1996 | Marinoni | 49/388 |
| 5,548,869 | A * | 8/1996 | Ryczek | 16/93 R |
| 5,613,276 | A * | 3/1997 | Franz | 16/229 |
| 6,609,335 | B1 * | 8/2003 | Hyakkoku | 49/388 |
| 6,925,685 | B2 * | 8/2005 | Chen | 16/332 |
| 7,127,777 | B2 * | 10/2006 | Chiang | 16/252 |
| 7,305,796 | B2 * | 12/2007 | Chiang | 49/388 |
| 7,594,302 | B2 * | 9/2009 | Balenzano | 16/252 |
| 2005/0144757 | A1 * | 7/2005 | Chiang | 16/252 |
| 2006/0277716 | A1 * | 12/2006 | Sprague | 16/252 |
| 2007/0113377 | A1 * | 5/2007 | Brachert | 16/247 |
| 2008/0168621 | A1 * | 7/2008 | Lin | 16/252 |
| 2011/0214254 | A1 * | 9/2011 | Fellman | 16/252 |
| 2012/0311817 | A1 * | 12/2012 | Bacchetti | 16/51 |

FOREIGN PATENT DOCUMENTS

| | | | |
|---|---|---|---|
| EP | 792990 | A1 * | 9/1997 |
| EP | 1319359 | A2 * | 6/2003 |
| WO | WO 2004085780 | A1 * | 10/2004 |

* cited by examiner

*Primary Examiner* — Chuck Mah
(74) *Attorney, Agent, or Firm* — Muncy, Geissler, Olds & Lowe, PLLC

(57) ABSTRACT

The present invention is related to an auto-return apparatus of a glass door, comprising a clamping base, a damper and a misalignment adjuster. The clamping base is secured onto the glass door and comprises a securing axle. The securing axle comprises an eccentric cam and the damper is received within the clamping base and abuts the eccentric cam of the securing axle to provide resisting force for door opening and closing. The misalignment adjuster comprises a moving plate and a securing means. The moving plate comprises a long slot provided for the securing means to pass therethrough and a mounting slot provided for the securing axle to be connected thereto such that the moving plate moves together with the clamping base along the extending direction of the long slot and relative to the securing means in order to achieve the objective of adjusting misalignment of the glass door.

7 Claims, 8 Drawing Sheets

AUTO-RETURN APPARATUS FOR GLASS DOOR

BACKGROUND OF THE INVENTION

1. Technical Field

The present invention is related to an auto-return apparatus for glass door, in particular, to an auto-return apparatus provided for the ease of adjustment of misalignment thereof.

2. Description of Related Art

As a common practice of installing glass doors, the door piece of the glass door and the door frame are drilled respectively to form a number of hinge holes and the hinge is then fastened to the hinge holes with screws such that the door piece can be pivotally turned relative to the door frame by the hinge. However, since tolerance errors usually occurs during the drilling of the holes, if the hinge is still forced to be fastened on the holes under such condition, the door piece of the glass door would not be aligned with the door frame and misalignment therefore occurs as a result. In order to solve the tolerance errors of the drilling, installers would commonly grind the hinge holes to be of a greater hole diameter prior to the installing of the hinge; nevertheless, the grinding of the holes is likely to cause cracks on the glass or the grinded hinge holes are likely to be of a smaller distance from each other and causing fractures on the glass between the two holes.

In view of the above, the installation of glass door utilizing traditional hinges can be troublesome and the tolerance errors occurred after the completion of the installation can still cause the doors to be unable to close properly; therefore, traditional hinges are not suitable for glass doors.

BRIEF SUMMARY OF THE INVENTION

A main objective of the present invention is to provide an auto-return apparatus for a glass door to facilitate the installation of the glass door and to promptly adjust the misalignment thereof.

In order to achieve the abovementioned objective, an auto-return apparatus for a glass door comprises a clamping base, a damper and a misalignment adjuster. The clamping base has a base and a securing axle. The base is provided for clamping and securing the glass door and comprises an oil reservoir for reserving a hydraulic oil and an axial hole perpendicularly and fluidly connected to said oil reservoir; said securing axle is axially attached to the axial hole of the base and comprises an axial shaft and an eccentric cam attached to the axial shaft; said axial shaft comprises a mounting end extended outward from the axial hole. The damper is received within the oil reservoir and abuts said eccentric cam of said securing axle such that the damper is pushed by said eccentric cam to compress said hydraulic oil to generate a resisting force for door opening and closing. The misalignment adjuster comprises a moving plate and at least one securing means; said moving plate comprises at least one long slot and a mounting slot, said long slot provided for said securing means to pass therethrough and to secure thereon, said mounting slot is provided for said mounting end of said axial shaft of said securing axle to secure thereon such that said moving plate moves together with said clamping base along an extending direction of said long slot and relative to said securing means and such that the problem associated with the left/right misalignment of the glass door is overcome.

In the auto-return apparatus of the present invention, the moving plate comprises an adjustable screw hole connected to the mounting slot; said adjustable screw hole extends perpendicularly to the extending direction of the long slot and is provided for an adjustable screw to be fastened therein. An end of said adjustable screw penetrates into the mounting slot and abuts the mounting end of the axial shaft of the securing axle such that the front/rear misalignment of the glass door can be adjusted by pushing or moving the clamping base thereof.

DETAILED DESCRIPTION OF THE INVENTION

A preferred embodiment of the present invention is provided in the following accompanied with the drawings to describe and illustrate the structure, technical features and effects of the present invention detailed as the following.

Figure 1:
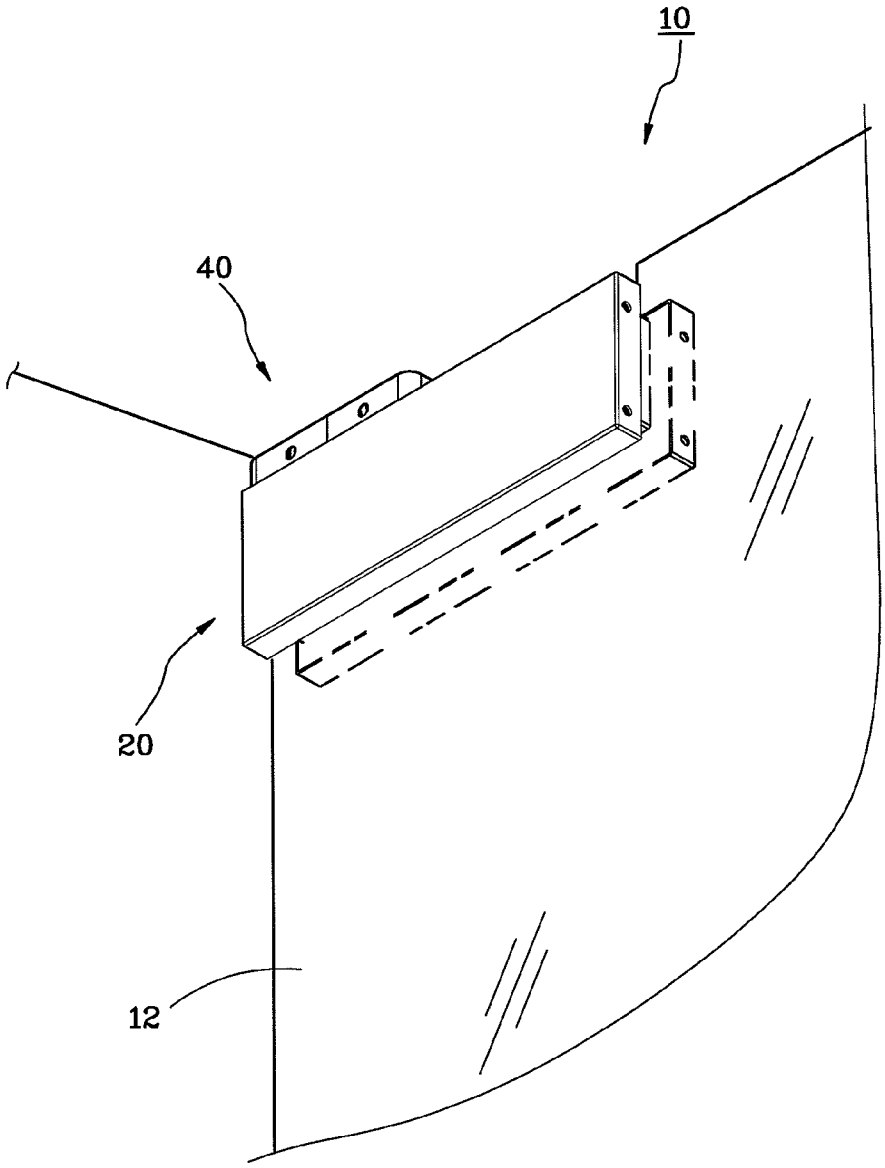
FIG. 1 is a perspective view of a preferred embodiment of the present invention installed onto a glass door.
Figure 2:
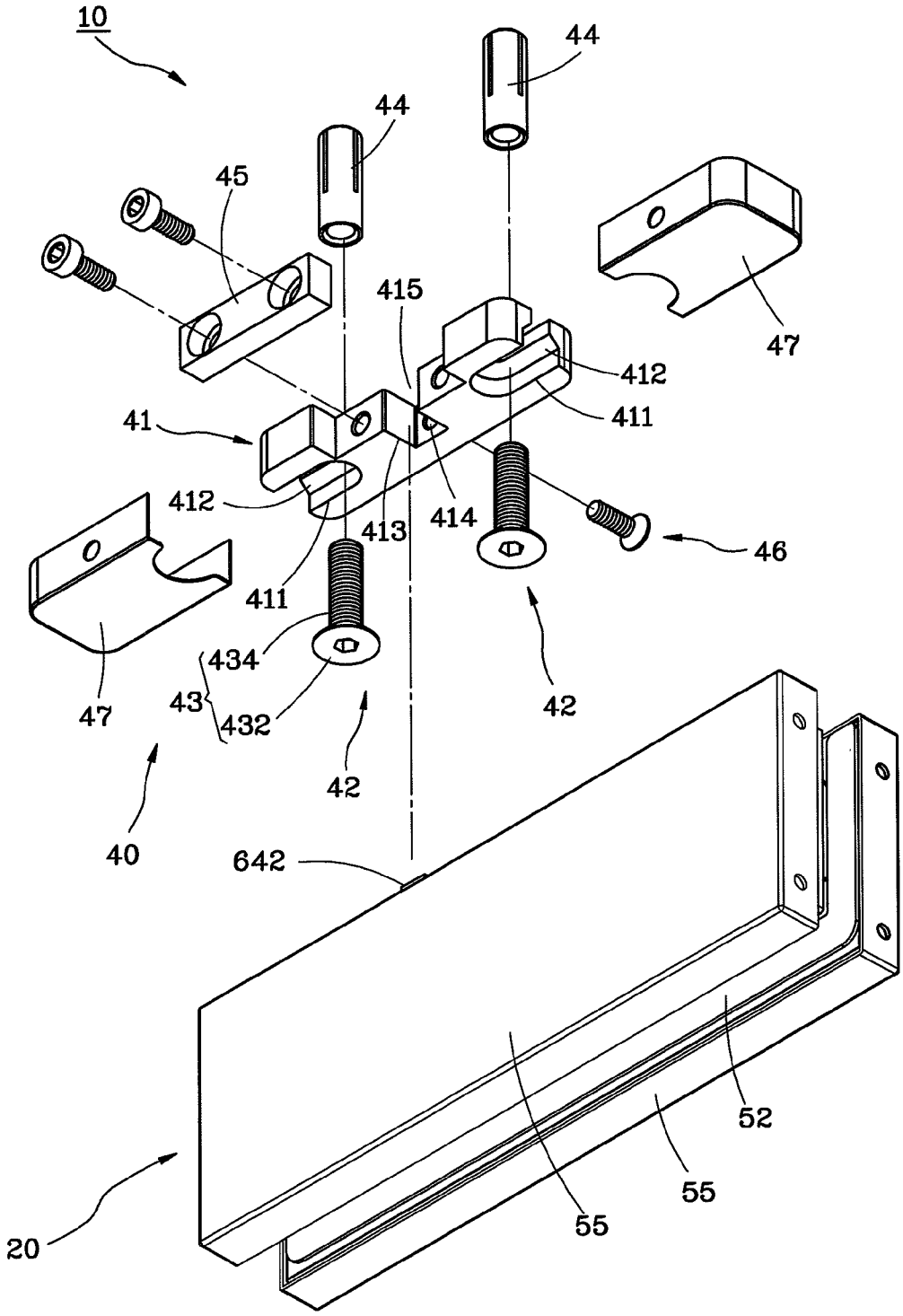
FIGS. 2 and 3 show partial perspective views of a preferred embodiment of the present invention.
Figure 3:
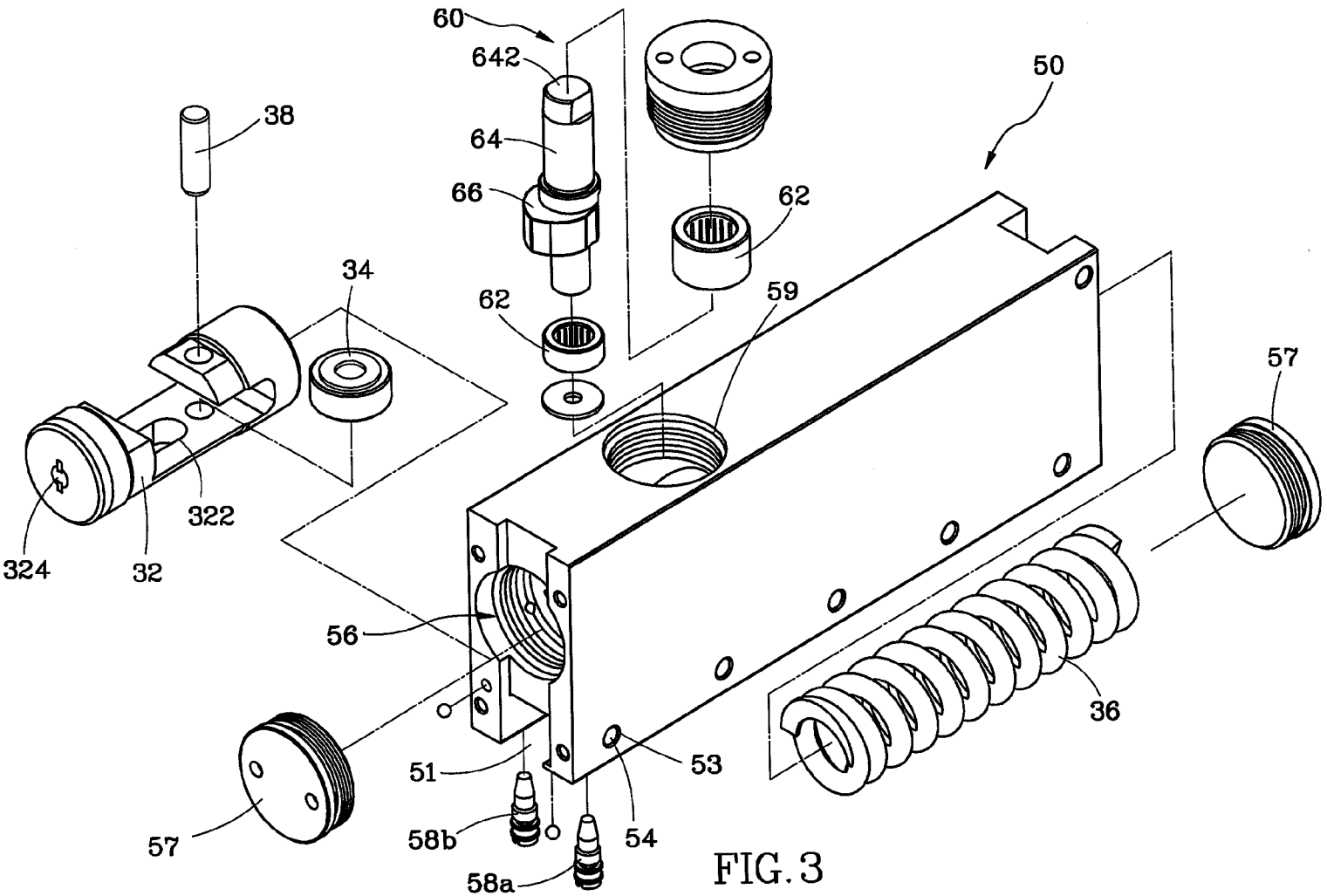

Referring now to FIGS. 1 to 3. A preferred embodiment of the present invention provides a an auto-return apparatus 10 comprising a clamping base 20, a damper 30 and a misalignment adjuster 40.

Figure 4:
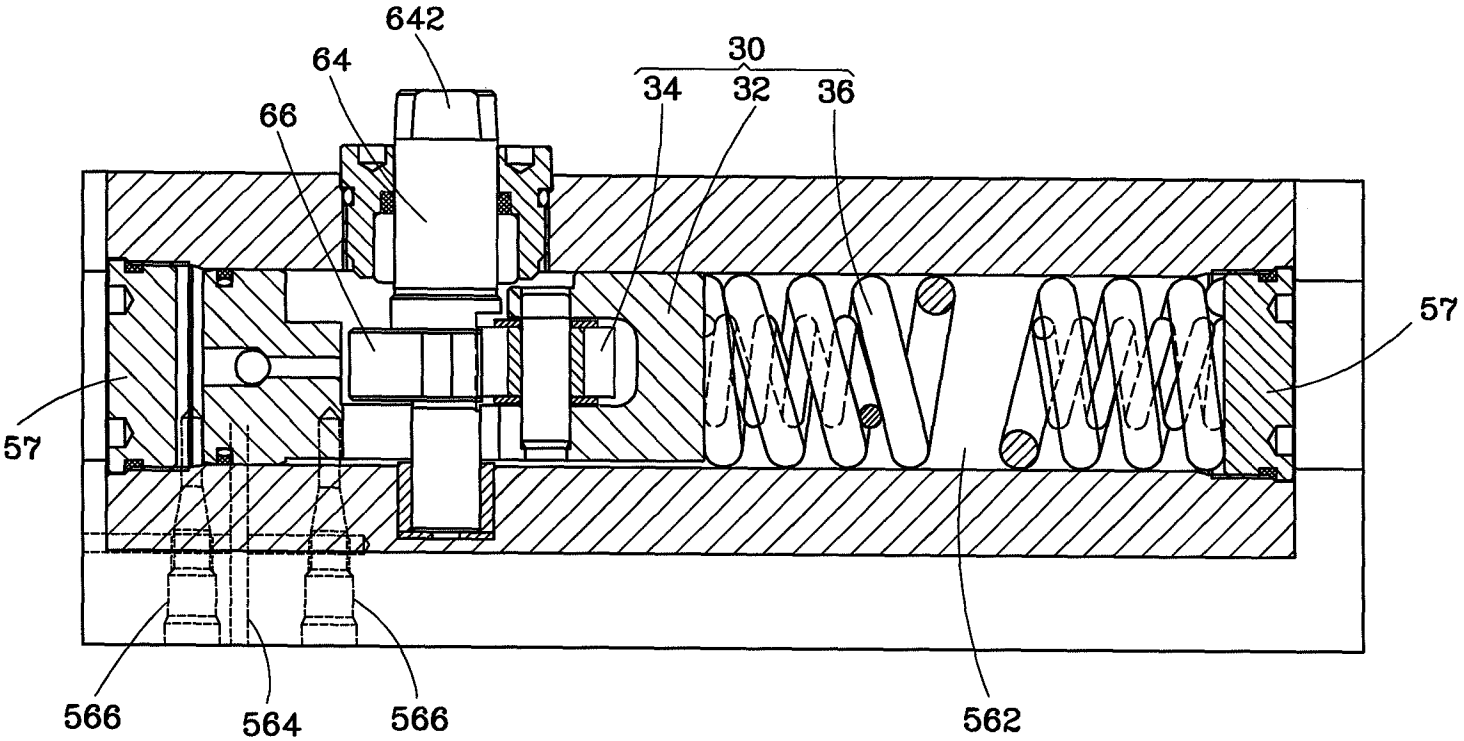
FIG. 4 is a cross sectional view of a preferred embodiment of the present invention provided with the clamping base and the damper.

The clamping base 20 comprises a base 50 and a securing axle 60 as shown in FIGS. 2 and 3; wherein:

A bottom edge of the base 50 comprises a clamping slot 51 provided for the attachment of a top edge of the glass door 12 thereon and a clamping strip 52 can be provided or received within the clamping slot 51 based on desired needs to prevent direct contact with the glass door 12. Two sides of the base 50 are respectively formed of a plurality of screw holes 53 connected to the clamping slot 51. By fastening a plurality of top-abutting screws 54 into the plurality of screw holes 53 respectively, the plurality of top-abutting screws 54 abut the two clamping strips 52 to clamp the top edge of the glass door 12 tightly. Furthermore, as shown in FIG. 1, the two sides of the base 50 can be installed with a decorative plate 55 based on desired needs to provide decoration to the outer appearance of the base 50. Also as shown in FIG. 4, an internal of the base 50 is provided with a oil reservoir 56. By attaching two end caps 57 to the two ends of the base 50, the oil reservoir 56 is sealed. The oil reservoir 56 is divided into a space 562, a oil conduit 564 and two valve holes 566 spaced apart from each other. The oil conduit 564 is fluidly connected to the space 562 and each one of the valve holes 566 is fluidly connected to the space 562 and the oil conduit 564 such that an adjustable valve 58*a*, 58*b* can be attached thereon. Additionally, the top surface of the base 50 is provided with an axial hole 59 perpendicularly and the axial hole 59 is fluidly connected to the space 562 of the oil reservoir 56.

The securing axle 60 is pivotally attached to the axial hole 59 of the base 50 via two bearings 62 and comprises an axial shaft 64 and an eccentric cam 66 attached to the axial shaft 64; wherein the axial shaft 64 comprises a mounting end 642 extend from the axial hole 59.

The damper 30 is received within the oil reservoir 56 of the clamping base 20 and comprises a piston 32, a securing block 34 and a spring element 36. As shown in FIG. 3, the piston 32 comprises a long hole 322 provided for the axial shaft 64 of the securing axle 60 to pass therethrough, and each one of the two ends of the piston 32 respectively comprises an oil hole 324 to allow the hydraulic oil to pass through. The securing block 34 is secured to the piston 32 via an insertion 38 and abuts the eccentric cam 66 of the securing axle 60 such that as the securing block 34 abuts and is pushed by the eccentric cam 66 of the securing axle 60, the piston 32 is being moved altogether to compress the hydraulic oil to generate the resisting force for door opening and closing. Two ends of the spring element 36 abut the end surface of the piston 32 and one of the end caps 57 of the clamping base 20 respectively in order to provide the return force.

Figure 6A:
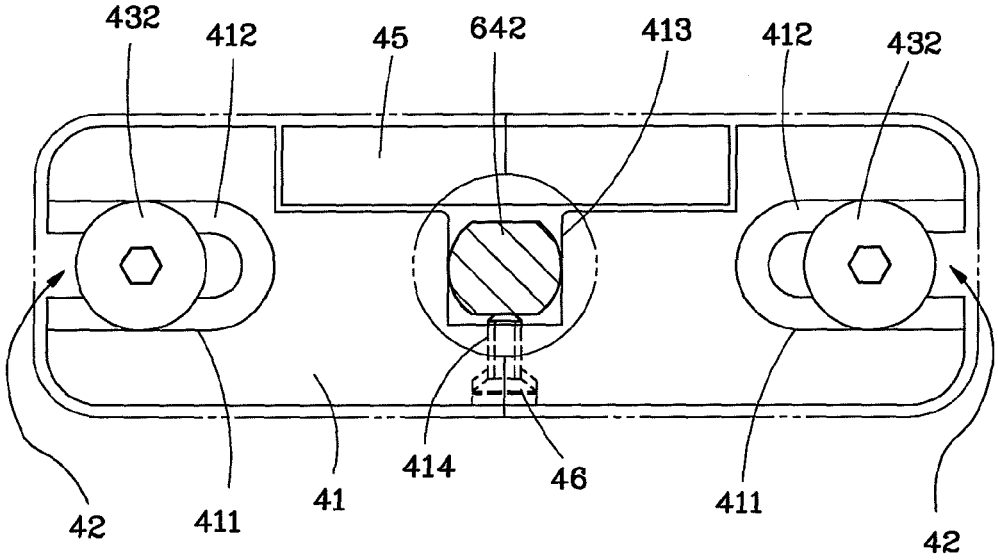
FIGS. 6A to 6C are bottom views of a preferred embodiment of the present invention provided with the misalignment adjuster, showing the conditions of correcting the left/right misalignment of the glass door.

The misalignment adjuster 40 comprises a moving plate 41 and two securing means 42. As shown in FIGS. 2 and 6A, each one of the left and right ends of the moving plate 41 respectively comprises a long slot 411, and a wall of the long slot 411 comprises a stepped portion 412. In this embodiment, each one of the securing means 42 comprises a securing screw 43 and a screw cap 44. The securing screw 43 comprises a head portion 432 and a threaded portion 434 extended form the head portion 432, and the screw cap 44 is buried into a ceiling. During the securing of the moving plate 41, the threaded portion 434 of the securing screw 43 passes through the long slot 411 of the moving plate 41 and is then fastened into the screw cap 44 gradually. Once the securing screw 43 is fastened, the head portion 432 of the securing screw 43 abuts the stepped portion 412 of the long slot 411, and the screw cap 44 then expands radially, which causes the moving plate 41 to be secured onto the ceiling and allows the moving plate 41 to move along an extending direction of the long slot 411 and relative to the securing means 42 upon an exertion of an external force. Furthermore, a mounting slot 413 and an adjustable screw hole 414 are provided between the moving plates 41. The extending direction of the mounting slot 413 is perpendicular to the extending direction of the long slot 411 and is formed with an opening 415 on one end thereof on a side of the moving plate 41 and another end thereof connecting to the adjustable screw hole 414. The opening 415 is covered by a blocking plate 45 fastened to the moving plate 41. The adjustable screw hole 414 is axially perpendicular to the extending direction of the long slot 411 and is provided for an adjustable screw 46 to fasten thereto. An end of the adjustable screw 46 penetrates into the mounting slot 413. During its assembly with the clamping base 20, the mounting end 642 of the axial shaft 64 of the securing axle 60 is mounted into the mounting slot 413 of the moving plate 41 and abuts the end of the adjustable screw 46 such that the clamping base 20 is able to pivot about the securing axle 60 in response to the opening and closing of the glass door 12. In addition, each one of the two ends of the moving plate 41 can be further provided with a protective cover 47 respectively to cover the two securing means 42 as means of protection thereof.

The above recites the detailed structure of the auto-return apparatus 10 of the present invention. In the following, the modes of operation and features are further described and illustrated.

Figure 5A:
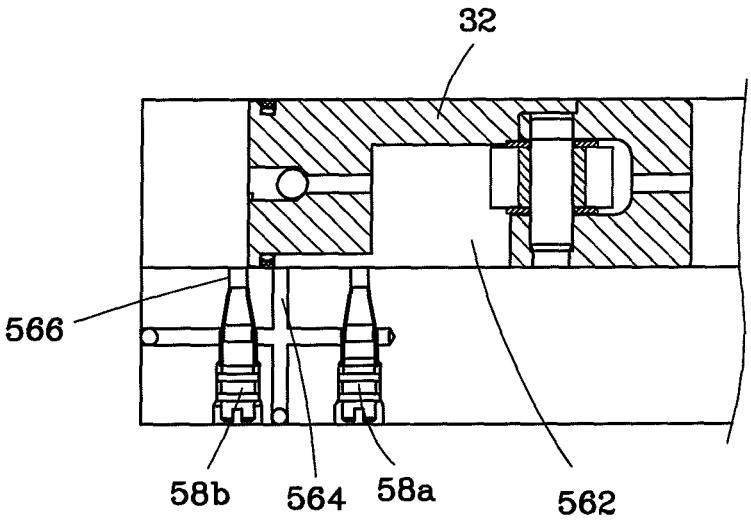
FIGS. 5A to 5D are partial cross sectional views of a preferred embodiment of the present invention, showing the process of the piston compressing the hydraulic oil.
Figure 5B:
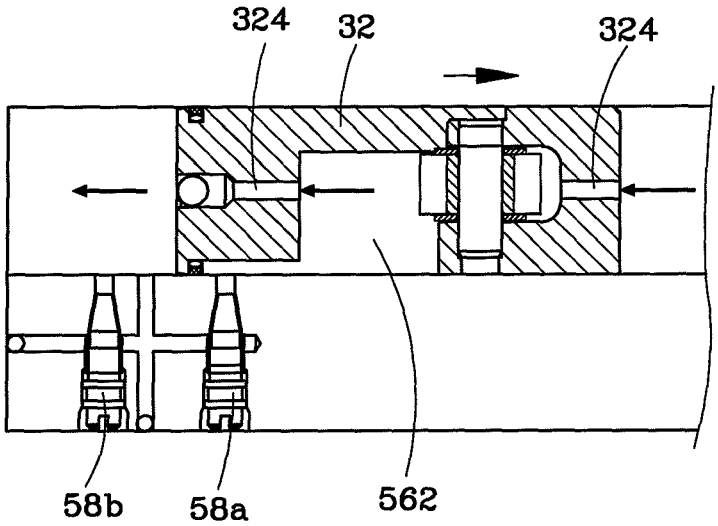

As the glass door 12 is pushed open, the clamping base 20 pivots around the rotation center of the securing axle 60 along with the glass door 12, during which the piston 32 is moved in the space 562 of the oil reservoir 56 due to the push of the eccentric cam 66 of the securing axle 60. The hydraulic oil is then being compressed by the piston 32 to flow from the oil hole 324 on the right end of the piston 32 to the left end thereof as shown in FIGS. 5A to 5B.

Figure 5C:
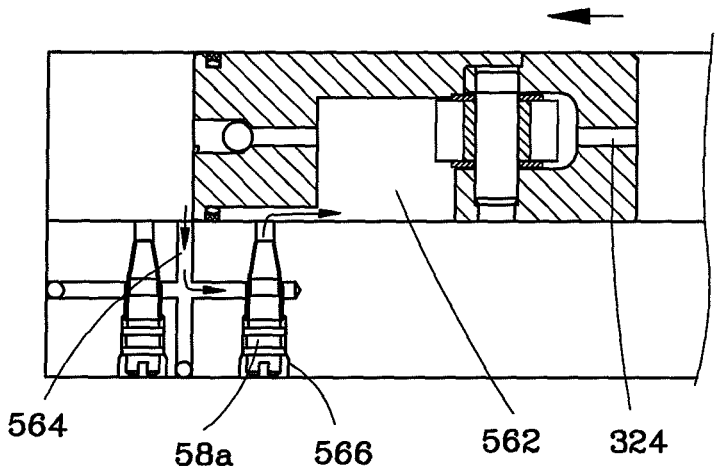
Figure 5D:
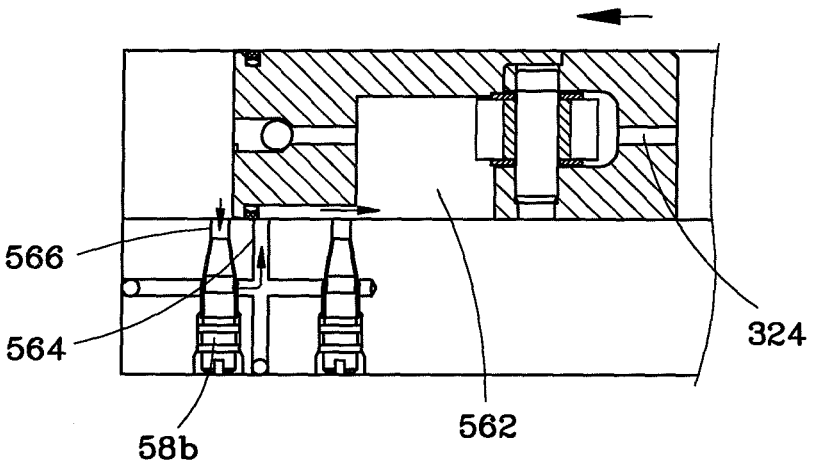

When the closing of the glass door 12 begins, the piston 32 compresses the hydraulic oil due to the push of the spring element 36, forcing the hydraulic oil to flow through the oil conduit 564 and the adjustable valve 58*a* and then to the space 562 via the valve hole 566 as well as to the right end of the piston 32 via the oil hole 324 of the piston 32, as shown in FIG. 5C. As the closing of the glass door 12 continues, the piston 32 blocks the entrance of the oil conduit 564, forcing the hydraulic oil to flow from the valve hole 566 to the adjustable valve 58*b* and then to the space 562 via the oil conduit 564 as well as to the right end of the piston 32 via the oil hole 324 of the piston 32 until the glass door 12 is completely closed, as shown in FIG. 5D. If the speed of closing of the glass door 12 at different stages is to be adjusted, one can achieve so by adjusting the adjustable valves 58*a*, 58*b* respectively for different amounts of oil.

Figure 6B:
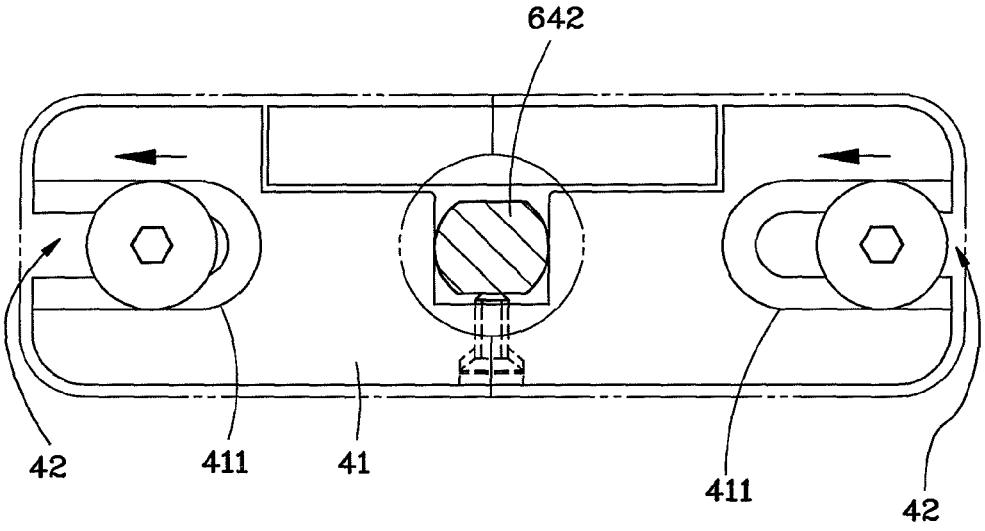
Figure 6C:
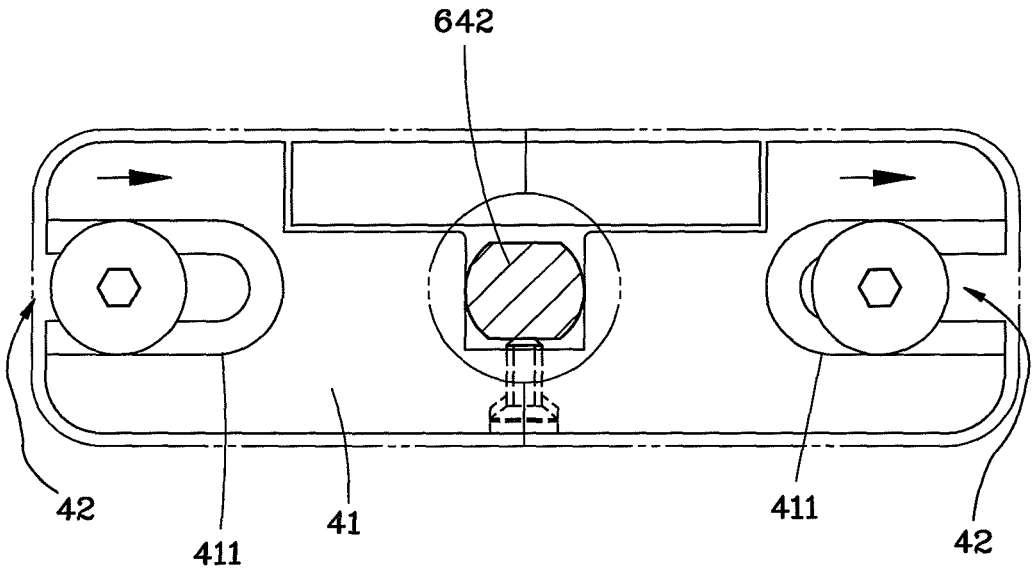
Figure 7:
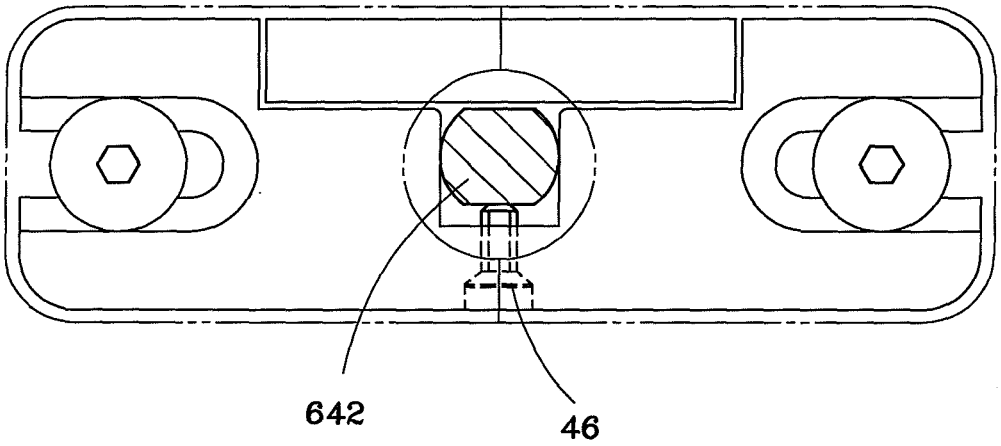
FIG. 7 is a bottom view of a preferred embodiment of the present invention provided with the misalignment adjuster, showing the conditions of correcting the front/rear misalignment of the glass door.

On the other hand, if left/right misalignment occurs during the closing of the glass door 12, one can take off the protective cap 47 and force the moving plate 41 to move left and right along the direction of the long slot 411, as shown in FIGS. 6A to 6C. As the clamping base 20 is secured onto and together with the moving plate 41 via the mounting end 642 of the axial shaft 64 of the securing shaft 60, the clamping base 20 is able to move together with the glass door 12 following the left and right movement of the moving plate 41 until the left/right misalignment of the glass door 12 is corrected or fixed. Furthermore, if front/rear misalignment occurs during the closing of the glass door 12, one can turn the adjustable screw 46 in order to have the end of the adjustable screw 46 abutting the mounting end 642 of the axial shaft 64 of the securing axle 60 such that the clamping base 20 is being moved altogether to correct the front/rear misalignment of the glass door 12, as shown in FIG. 7.

In view of the above, the auto-return apparatus 10 of the present invention can be secured onto the ceiling with only two securing means 42 during its installation, making the installation easy and simple; and it can also utilize the oil resisting force between the damper 30 and the hydraulic oil to act as a force buffer to the opening and closing of the door. In addition, the auto-return apparatus 10 of the present invention allows the glass door 12 to be further adjusted after the installation thereof such that the misalignment of the glass door 12 can be effectively resolved and corrected, achieving the objectives of the present invention.

What is claimed is:

1. An auto-return apparatus for a glass door, comprising:

a clamping base, having a base and a securing axle; said base provided for clamping and securing said glass door and comprising an oil reservoir for reserving a hydraulic oil and an axial hole perpendicularly and fluidly connected to said oil reservoir; said securing axle axially attached to said axial hole of said base and comprising an axial shaft and an eccentric cam attached to said axial shaft; said axial shaft comprising a mounting end extended outward from said axial hole;

a damper, received within said oil reservoir and abutting said eccentric cam of said securing axle such that the damper is pushed by said eccentric cam to compress said hydraulic oil to generate a resisting force for door opening and closing; and a misalignment adjuster, having a moving plate and at least one securing means provided for securing said misalignment adjuster to a doorframe or a ceiling; said moving plate comprising at least one long slot and a mounting slot, said long slot provided for said securing means to pass therethrough and to secure thereon, said mounting slot provided for said mounting end of said axial shaft of said securing axle to secure thereon such that said moving plate moves together with said clamping base along an extending direction of said long slot and relative to said securing means.

2. The auto-return apparatus for a glass door of claim 1, wherein said at least one long slot of said moving plate comprises two long slots arranged on two opposing sides of said mounting slot; said at least one securing means comprises two securing means and are secured in one of said long slots respectively.

3. The auto-return apparatus for a glass door of claim 2, wherein said misalignment adjuster further comprises two protective caps, said two protective caps are mounted on two ends of said moving plate, covering said two securing means.

4. The auto-return apparatus for a glass door of claim 2, wherein walls of each said long slot comprises a stepped portion, each said securing means comprises a screw and a screw cap, said screw comprises a head portion and a threaded portion, said head portion abuts said stepped portion of said long slot, said threaded portion extends from said head portion to pass through said long slot and fastened into said screw cap.

5. The auto-return apparatus for a glass door of claim 1, wherein said moving plate comprises an adjustable screw hole connected to said mounting slot, said adjustable screw hole extends perpendicularly to an extending direction of said long slot, said misalignment adjuster further comprises an adjustable screw fastened into said adjustable screw hole and penetrated into said mounting slot with an end thereof to abut said mounting end of said axial shaft of said securing axle.

6. The auto-return apparatus for a glass door of claim 5, wherein said mounting slot is of an extending direction perpendicular to said extending direction of said long slot, and one end of said mounting slot comprises an opening and another end thereof connected to said adjustable screw hole; said misalignment adjuster further comprises a blocking plate, said blocking plate is secured to one side of said moving plate and covering said opening of said mounting slot.

7. The auto-return apparatus for a glass door of claim 1, wherein said damper comprises a piston, a securing block and a spring member; said piston comprises a long hole provided for said axial shaft of said securing axle to pass therethrough; said securing block is attached to said piston and abuts the eccentric cam of the securing axle; one end of said spring member abuts said piston.

* * * * *